United States Patent [19]

Ramsauer et al.

[11] 4,010,303

[45] Mar. 1, 1977

[54] TUFTED CARPET WITH WOVEN RIBBON BACKING OF POLYAMIDE AND POLYESTER

[75] Inventors: Otto Ramsauer, Wuppertal; Heribert Dau, Elsenfeld; Willi Gumbmann, Obernburg; Ulrich Schulze, Immenstadt, all of Germany

[73] Assignee: Akzona Incorporated, Asheville, N.C.

[22] Filed: Apr. 14, 1976

[21] Appl. No.: 676,845

[30] Foreign Application Priority Data

Apr. 16, 1975 Germany ..... 7512027[U]

[52] U.S. Cl. ..... 428/95; 428/373

[51] Int. Cl.[2] ..... B32B 3/02; B32B 33/00

[58] Field of Search ..... 428/95, 93, 94, 97, 428/373

[56] References Cited

UNITED STATES PATENTS

| | | | |
|---|---|---|---|
| 3,317,366 | 5/1967 | Dionne | 428/95 |
| 3,542,632 | 11/1970 | Eickhoff | 428/95 |
| 3,613,612 | 5/1965 | Kennedy | 428/95 |
| 3,864,195 | 2/1975 | Patterson | 428/95 |

*Primary Examiner*—Marion E. McCamish
*Attorney, Agent, or Firm*—Francis W. Young; Jack H. Hall

[57] ABSTRACT

A tufted nylon carpet having ribbon-shaped warp and filling yarns made from a mixture of 65 to 80 weight percent polyamide and 20 to 35 weight percent polyester. The yarns of the fiber exhibit a reduced tendency to split and the carpet has high dimensional stability and a very level appearance.

5 Claims, No Drawings

TUFTED CARPET WITH WOVEN RIBBON BACKING OF POLYAMIDE AND POLYESTER

BACKGROUND OF THE INVENTION

The invention relates to a tufted carpet with a backing made of ribbon-shaped warp and weft yarns.

Most of the carpets currently being produced are so-called carpets consisting of essentially the backing, the pile and an adhesive coating which is used to anchor the pile in the backing. Woven fabrics are frequently used for carpet backing.

The manufacture of jute carpet backings for tufted carpets is known. One drawback of carpets embodying such backing fabric is the relatively high sensitivity to moisture, since in the presence of water the jute backing will be subjected to a comparatively high shrinkage. Moreover, such jute tufting backings exhibit a relatively high bleeding tendency so that the same colors may produce considerable shade variations in piece-dyeing of different lots. Since jute yarns need in most cases to have a relatively high twist, there is not infrequently during tufting a formation of streaks or so-called gaps, as the tufting needles are deflected, which impairs the appearance of the carpet.

It is also known how to manufacture carpet backings from ribbon-shaped warp and filling yarns of synthetic polymers, whereby the synthetic material being most frequently used is polypropylene. The drawback encountered in using polypropylene for the warp and filling is that the carpet backings cannot be dyed or only very unsatisfactorily so, and that after dyeing of the carpet the light color of the backing grins through the pile of the carpet. Polypropylene carpet backings are, moreover, lacking dimensional stability and tend to creep. Polyamide or polyester ribbons in the carpet backing have the added drawback that needle deflection in tufting is relatively frequent causing the carpet to have an uneven appearance.

DESCRIPTION OF THE INVENTION

The object of the innovation is to make a tufted carpet with a backing of ribbon-shaped warp and filling yarns of synthetic polymers, and pile yarns of polyamide, characterized by warp and filling yarns having a matrix-fibrillar structure made from a blend of 65 to 80 weight percent polyamide and 20 to 35 weight percent polyester. Warp and filling yarns consist preferably of a mixture of 70 to 80 weight percent polyamide and 20 to 30 weight percent polyester. Eminently suitable are such matrix-fibrillar structures with fibrils having a length between about 0.5 and 160 microns, preferably between 1.5 and 80 microns, and a diameter between 0.5 and 6, preferably between 0.5 and 1.5 microns. Polyethylene terephthalate is especially suited as polyester. It is also advantageous when the polyester in the mixture is also composed of a mixture of two different polyesters. Eminently suitable within the framework of the innovation are delustered warp and filling yarns. The delusterant content, e.g., titanium dioxide, may, e.g., be between 0.05 and 0.4%.

The matrix-fibrillar structure of the innovation is understood to refer to internal structures of molded elements of polymer mixtures, whereby one component forms a coherent structure, the so-called matrix, in which another component is embedded in the form of discontinuous fibrils or microfibers. Structures of this type are mentioned, e.g., in U.S. Pat. No. 3,704,191, Col. 5, paragraph 3. According to the innovation, the matrix is composed of polyamide.

The ribbons within the framework of the innovation have a lower splitting capacity or tendency; in other words, they do not simply break down into so-called split fiber structures or reticular structures under mechanical stressing. On the other hand, they do not offer high enough a resistance to the needles to cause tufting problems. Thus, in backings for tufted carpets, the ribbons have a much greater stability than propylene ribbons and do not tear in longitudinal direction.

Ribbon-shaped yarns, as provided by the innovation in tufted carpets, can be obtained, e.g., as follows. Dried chips of polyamide and polyester are mixed in an appropriate ratio and extruded to films. The polyester and polyamide can also be melted separately and the two melts can be mixed and made into film. Subsequently, the film can be slit to the desired width and the resulting ribbons are drawn. It is also possible first to draw the film and then slit the latter into ribbons. Drawing is accomplished preferably at temperatures above 100° C., a suitable drawing ratio is 1:3 to 1:5, but higher draw ratios may be selected. The thickness of the drawn ribbons may vary within relatively wide limits. Thicknesses between 25 and 50 microns are especially suitable.

The tufted carpet is produced according to well-known processes, whereby appropriate backing fabrics of ribbon-shaped material according to the innovation, and conventional latex and pile yarns of polyamide are used. The tufting process as such is known and need not be explained in further detail. The pile material consists of conventional polyamides, such as nylon 6 or nylon 66. Conventional latices can be used as latex. In addition to the backing fabric, also referred to as primary backing, the tufted carpet may have another, heavier, secondary backing which improves the anchoring of the pile yarn and which may, especially, increase the weight of the carpet.

Tufted carpets according to the innovation have a very level appearance, which is of particular benefit in patterned carpets. This improved evenness shows up in patterns obtained by dyeing methods as well as in patterns produced by using tufts of different heights.

The tufted carpet according to the innovation has a high dimensional stability. There is a good bond between latex and backing and pile material. The tufting material according to the innovation is very readily flattened and covered. Difficulties in piece-dyeing in the form of bleeding or non-dyeing of the backing are practically non-existent. The tufted carpet according to the invention can also be dyed directly in the form of long strips on continuous dye equipment. The notorious floating often observed with carpet strips with a polypropylene backing is not encountered.

The invention is illustrated in the following example:

EXAMPLE

A mixture of chips of 80% polyamide and 20% polyethylene terephthalate is dried and a film is cast therefrom using a single-screw extruder with a 400 mm. wide extruding die. Subsequently, the film is slit into ribbons and drawn to a ratio of 1:3.6.

The ribbons serve to weave a backing fabric in plain weave. A greige carpet is produced by the known needle tufting technique by insertion of a polyamide pile material using a Singer Cobble Tufting machine of conventional design and gauge, which greige carpet is then conventionally dyed with acid dyes on a winch vat, then extracted, dried and provided with a coating to anchor the pile, which coating is simultaneously the adhesive for a jute laminate. The tufting support material is dyed the same shade as the pile material.

What is claimed is:

1. Tufted nylon carpet having a backing of ribbon-shaped warp and filling yarns having a reduced splitting tendency comprising a matrix-fibril structure of a mixture of 65 to 80% by weight polyamide and 20 to 35% by weight polyester, wherein the matrix consists of polyamide and the fibrils, consisting of polyester, are discontinuous.

2. The tufted carpet of claim 1, characterized by warp and filling yarns of a mixture of 70 to 80% by weight polyamide and 20 to 30% by weight polyester.

3. The tufted carpet of claim 2, wherein the length of the fibrils is from 1.5 to about 160 micron and the diameter of the fibrils is from about 0.5 to about 6 microns.

4. The tufted carpet of claim 3, wherein the length of the fibrils is from about 15 to 80 microns and the diameter of the fibrils is from about 0.5 to about 1.5 microns.

5. The tufted carpet of claim 4, wherein the warp and filling yarns contain a delusterant.

* * * * *